US005336040A

United States Patent [19]

Focke et al.

[11] Patent Number: 5,336,040

[45] Date of Patent: Aug. 9, 1994

[54] PROCESS AND APPARATUS FOR GRASPING LIFTING AND MOVING STACKS OF BLANKS FOR CIGARETTE PACKS

[75] Inventors: Heinz Focke, Verden; Henry Buse, Visselhövedo, both of Fed. Rep. of Germany

[73] Assignee: Focke & Co., Verden, Fed. Rep. of Germany

[21] Appl. No.: 895,833

[22] Filed: Jun. 9, 1992

Related U.S. Application Data

[62] Division of Ser. No. 589,566, Sep. 28, 1990, Pat. No. 5,144,789.

[30] Foreign Application Priority Data

Oct. 4, 1989 [DE] Fed. Rep. of Germany ..... 3933098

[51] Int. Cl.[5] ..... B65B 43/16; B65G 47/34

[52] U.S. Cl. ..... 414/751; 294/81.61; 294/87.1; 294/115; 414/795.8

[58] Field of Search ..... 294/81.61, 87.1, 87.22, 294/87.24, 88, 104, 106, 115; 53/389.1; 198/468.2; 414/280, 416, 736, 751, 753, 795.8, 796.9

[56] References Cited

U.S. PATENT DOCUMENTS

| | | | |
|---|---|---|---|
| 1,519,045 | 12/1924 | Panko | 294/81.61 X |
| 2,277,828 | 3/1942 | Morgan | 294/87.1 |
| 3,075,651 | 1/1963 | Kaden | 198/468.2 X |
| 3,714,870 | 2/1973 | Blatt | 294/88 X |
| 3,731,785 | 5/1973 | Stuart | 414/753 |
| 3,758,934 | 9/1973 | Hasselgren et al. | 414/796.9 X |
| 3,776,398 | 12/1973 | Stuart et al. | 414/796.9 X |
| 3,777,445 | 12/1973 | Anderson . | |
| 3,922,778 | 12/1975 | Aaldoel . | |
| 4,107,905 | 8/1978 | Grocke . | |
| 4,284,301 | 8/1981 | Geiger et al. | 294/87.1 X |
| 4,592,462 | 6/1986 | Mojden et al. | 414/795.8 X |
| 4,662,624 | 5/1987 | Focke | 414/795.8 X |
| 4,696,615 | 9/1987 | Ettischer . | |
| 4,907,941 | 3/1990 | Focke et al. . | |
| 4,936,438 | 6/1990 | Waineo . | |
| 5,004,396 | 4/1991 | Focke . | |
| 5,007,522 | 4/1991 | Focke et al. . | |

FOREIGN PATENT DOCUMENTS

| | | | |
|---|---|---|---|
| 329945 | 8/1989 | European Pat. Off. . | |
| 1511847 | 1/1970 | Fed. Rep. of Germany . | |
| 2416697 | 10/1974 | Fed. Rep. of Germany . | |
| 2716804 | 6/1980 | Fed. Rep. of Germany . | |
| 2423885 | 12/1982 | Fed. Rep. of Germany . | |
| 3519580 | 3/1987 | Fed. Rep. of Germany . | |
| 3307675 | 10/1987 | Fed. Rep. of Germany . | |
| 3627868 | 2/1988 | Fed. Rep. of Germany . | |
| 3627670 | 3/1988 | Fed. Rep. of Germany . | |
| 3632237 | 4/1988 | Fed. Rep. of Germany . | |
| 703467 | 12/1979 | U.S.S.R. | 294/81.61 |

*Primary Examiner*—Johnny D. Cherry
*Attorney, Agent, or Firm*—Sughrue, Mion, Zinn, Macpeak & Seas

[57] ABSTRACT

Process and apparatus for transporting stacks of blanks for producing (cigarette) packs. For the production of (cigarette) packs made of blanks (10) of thin cardboard, the blanks are delivered in the form of blank stacks (15), mainly in containers (cartons 16). Specially designed cassettes (32) are used for mechanically and mostly automatically conveying the blank stacks (15) to the packaging machines. The cassettes (32) are designed for holding the contents of a carton (16) of blank stacks (15). The cartons (16) are mechanically opened by a cutting unit (39) by way of cutting out a side wall (30). Special extraction units (59) pull out the blank stacks (15) through the open side of the carton and directly deposit these in an adjacent cassette (32). Centrally emptying the cartons (16) and mechanically transporting the blank stacks (15) by means of special implant cassettes (32) result in a mechanized transport circuit for the packaging material.

9 Claims, 10 Drawing Sheets

PROCESS AND APPARATUS FOR GRASPING LIFTING AND MOVING STACKS OF BLANKS FOR CIGARETTE PACKS

This is a division of application Ser. No. 07/589,566, filed Sep. 28, 1990, now U.S. Pat. No. 5,144,789.

BACKGROUND OF THE INVENTION

The invention relates to a process for transporting prefabricated blanks (made of thin cardboard) for packs, especially for producing cigarette packs of the hinge lid type, with stacks of blanks being delivered in packed cartons. The invention further relates to an apparatus for carrying out the process.

Transporting the packaging material presents an important problem as packaging machines reach increasingly higher performances. It is particularly difficult to supply packaging machines with blanks made of thin cardboard, for instance for the production of hinge lid cigarette packs.

Such blanks are normally produced away from the plant, for instance in a paper factory, and are delivered in stacks. In general, these blank stacks are introduced into magazines of the packaging machines by hand. The expenditure of manual labor is considerable due to the high capacity of these packaging machines. This is particularly the case, if—as is known practice—the blank stacks are delivered to the site of production in large cartons. After delivery it is necessary to open the carton first, take out the blank stacks and feed these into the magazines.

SUMMARY OF THE INVENTION

Setting out from this problem, the invention has the object to improve the handling and transport of blanks or blank stacks within a plant with preferably several packaging machines, such that only very little or no manual labour at all is needed.

In order to attain this object, the process as taught by the invention comprises the steps of opening the cartons (with the blank stacks), taking out the blank stacks, transferring these into special in-plant transport containers (cassettes) and feeding said stacks with these containers to expending sites (packaging machines) by means of a permanently installed transport system.

The basic idea of the invent ion is to use special transport containers, namely cassettes, which are adapted to the size and shape of the blank stacks. These cassettes make it possible to exclusively mechanically transport the blank stacks within the plant right to the magazines of the packaging machines The blank stacks are received in the region of a central distributing station and transferred to the plant-specific cassettes. If the blank stacks are delivered in closed cartons, they are opened in the distributing station to extract the blank stacks.

According to a further proposal of the invention, the process of transferring the blank stacks from the delivery containers, especially from the cartons, into the cassettes and of transferring the latter to the transport unit is mechanized and automatized as well.

It is a special feature of the apparatus as taught by the invention, that in the region of the distributing station, the cartons with the blank stacks are mechanically opened on one side by way of cutting one side wall out of the carton. For this purpose, a cutting unit is used which applies horizontal and vertical cuts along the edges of one side wall.

The mechanized extraction of the blank stacks from the cartons is a further outstanding feature of the invention. The invention provides a n extraction unit which grasps one, several or all blank stacks of the carton or a layer of the blank stacks in the car ton with clamping holders and pulls them out of the carton through the open side. Whenever there is a gap between two adjacent blank stacks leaving space for clamping means to get a grip, the extraction unit designed according to the invention can be employed. It is particularly advantageous to use said clamping means for (cigarette) hinge lid packs. The design of these packs is standardized in that an end portion of the blank, namely an inner lid flap, is smaller in relation to the rest of the blank. As a result, the blank stacks have a laterally directed projection providing a region in which a blank stack can be grasped by clamping holders.

The cassettes for transporting the blank stacks are designed such that the extraction unit can transfer the blank stack directly to the cassettes. In the area of discharge it is possible to extract the blank stacks from the cassettes by means of simple pushers as well.

Further features of the invention relate to the design of the distributing station, the cassettes, the extraction station and the cutting unit. In the following, further details of the process and the apparatus as taught by the invention are described in more detail with reference to a preferred embodiment and corresponding drawings, in which:

DESCRIPTION OF A PREFERRED EMBODIMENT OF THE INVENTION

Figure 1:
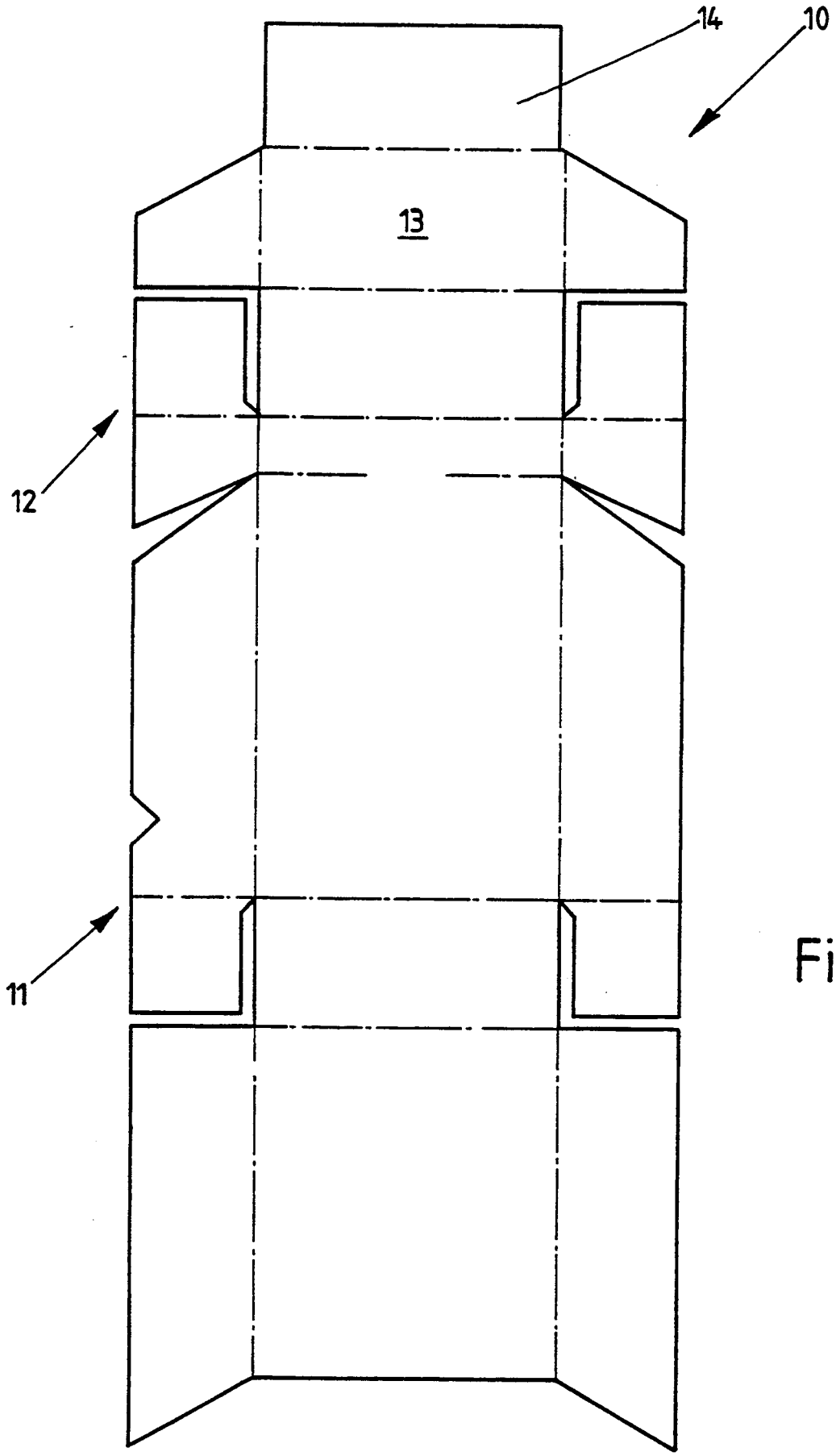
FIG. 1 shows a spread-out blank for a hinge lid pack being the preferred field of application of the invention.

The apparatus and its individual parts represented in the drawings are specifically directed to the handling of blanks 10 for producing hinge lid (cigarette) packs. One embodiment of such a blank 10 is shown in FIG. 1. Important for the mode of operation of parts of the apparatus is the—worldwide customary—shape of blank 10. Said blank consists of a plurality of walls and folding tabs for forming a pack portion 11 on the one hand and a lid 12 on the other. In this connection, the design of the parts of the lid 12 are of particular interest. A front lid wall 13 forming the end portion of the elongated blank 10 is provided with an inner lid flap 14. The latter is inwardly folded in the finished hinge lid pack, specifically against the inner side of the front lid wall 13. The inner lid flap 14 has a significantly smaller width than the rest of the blank 10. A blank stack 15 formed by these blanks 10 consequently forms a projection on one side, in the region of which the blank stack 15 can be grasped by handling means comprising clamping jaws for laterally grasping the inner lid tabs 14 stacked on top of one another.

Figure 2:
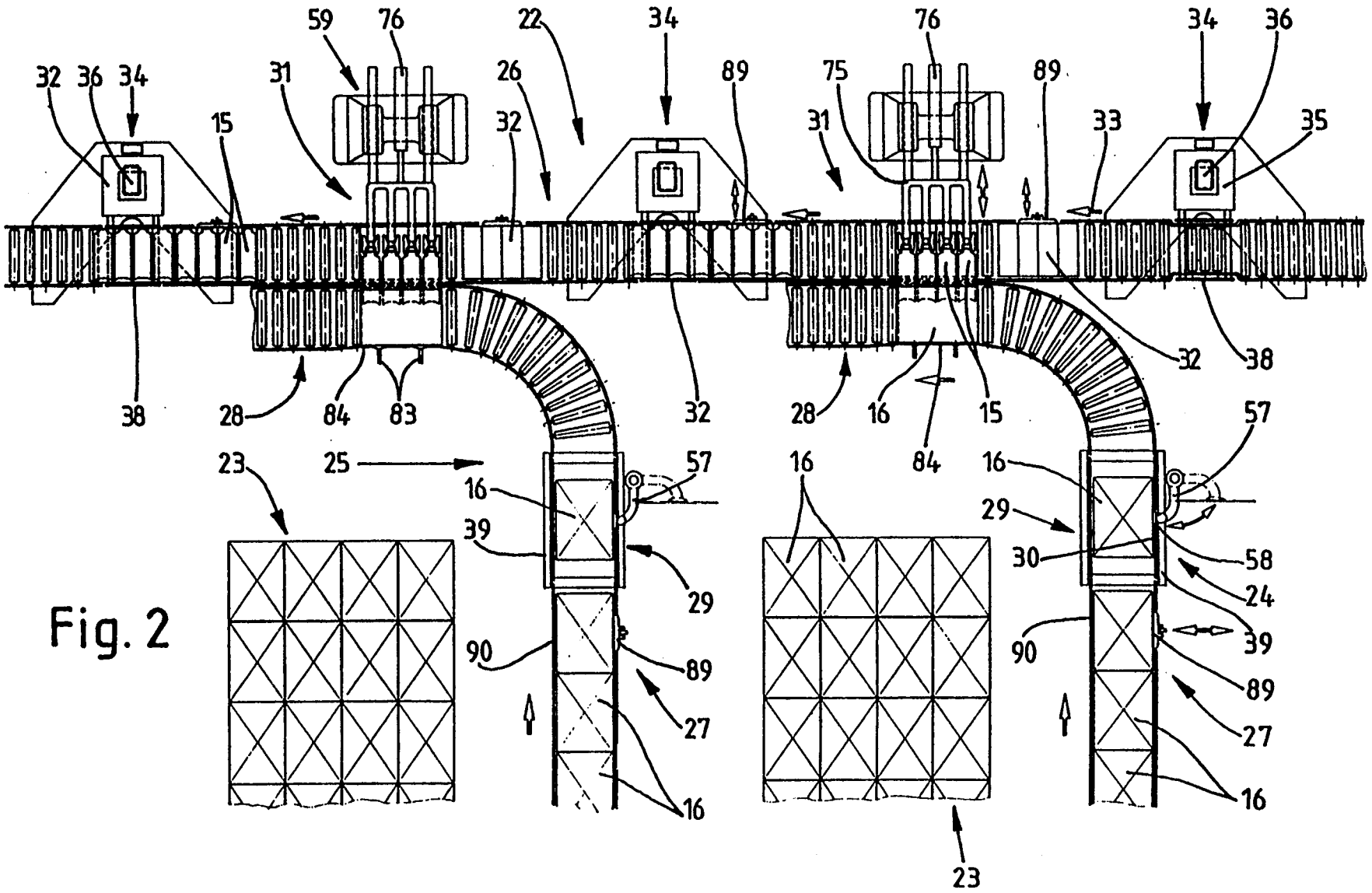
FIG. 2 shows a schematic plan view of a detail of the transport system for transporting blank stacks, namely a distributing station.

The blanks 10, designed for example in the aforedescribed way, are delivered as blank stacks 15 (FIG. 2). Several, in the present case four, blank stacks 15 comprising for instance 1000 blanks 10 each are contained in a closed carton 16. The object now is to take the blank stacks 15 out of the cartons 16 without any manual labor and to-feed them to packaging machines (not shown).

Figure 3:
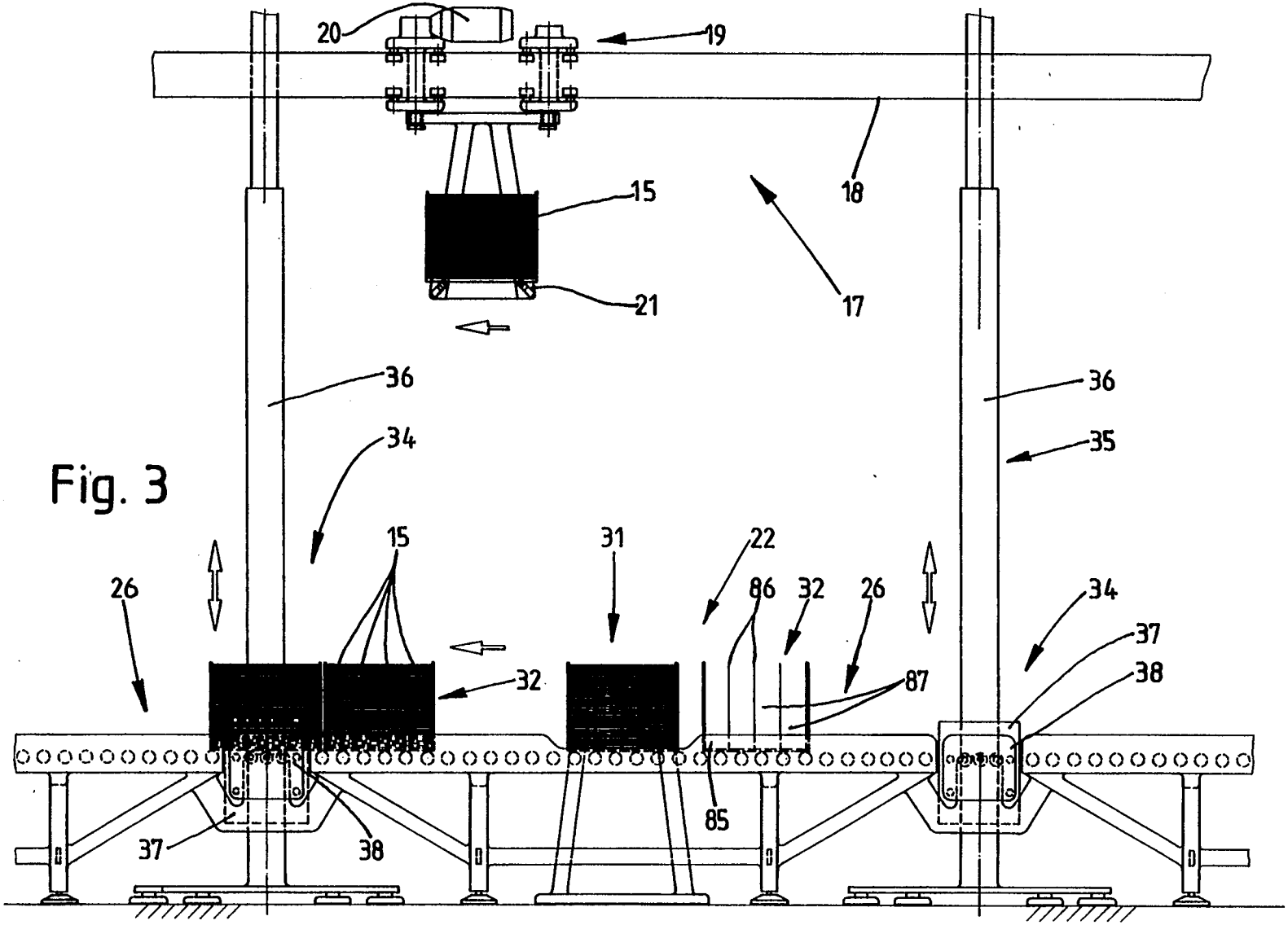
FIG. 3 shows a side view of an enlarged detail of the system according to FIG. 2.

A permanently installed conveying system 17 (FIGS. 3 and 4) serves for the mechanical transport of the blank stacks 15 within the plant which comprises several packaging machines. Here, this conveying system is designed as an overhead conveyor having a transport rail 18 extending in an elevated conveying plane. On said rail, running gears, i.e. runway trolleys 19 are movably mounted, each having its own drive in the form of a motor 20. At the underside of the runway trolleys 19 there are supporting frames 21 for holding the blank stacks 15. The runway trolleys 19 are driven to the individual expending sites for the blanks 10, i.e. to the packaging machines. Here, the blank stacks 15 are transferred to blank magazines of the machines in an appropriate way.

Figure 4:
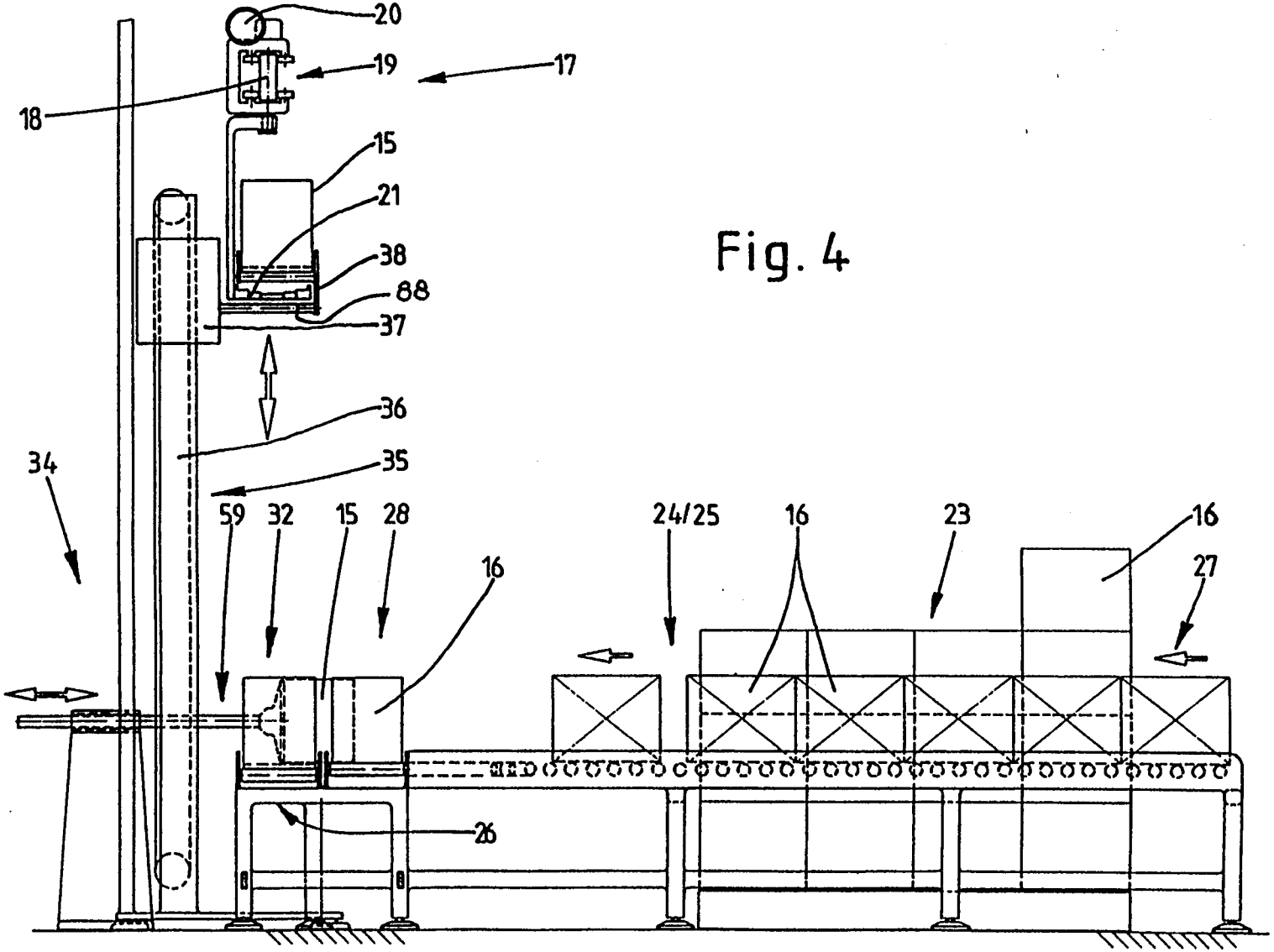
FIG. 4 shows a representation of the detail according to FIG. 3 turned by 90°.
Figure 5:
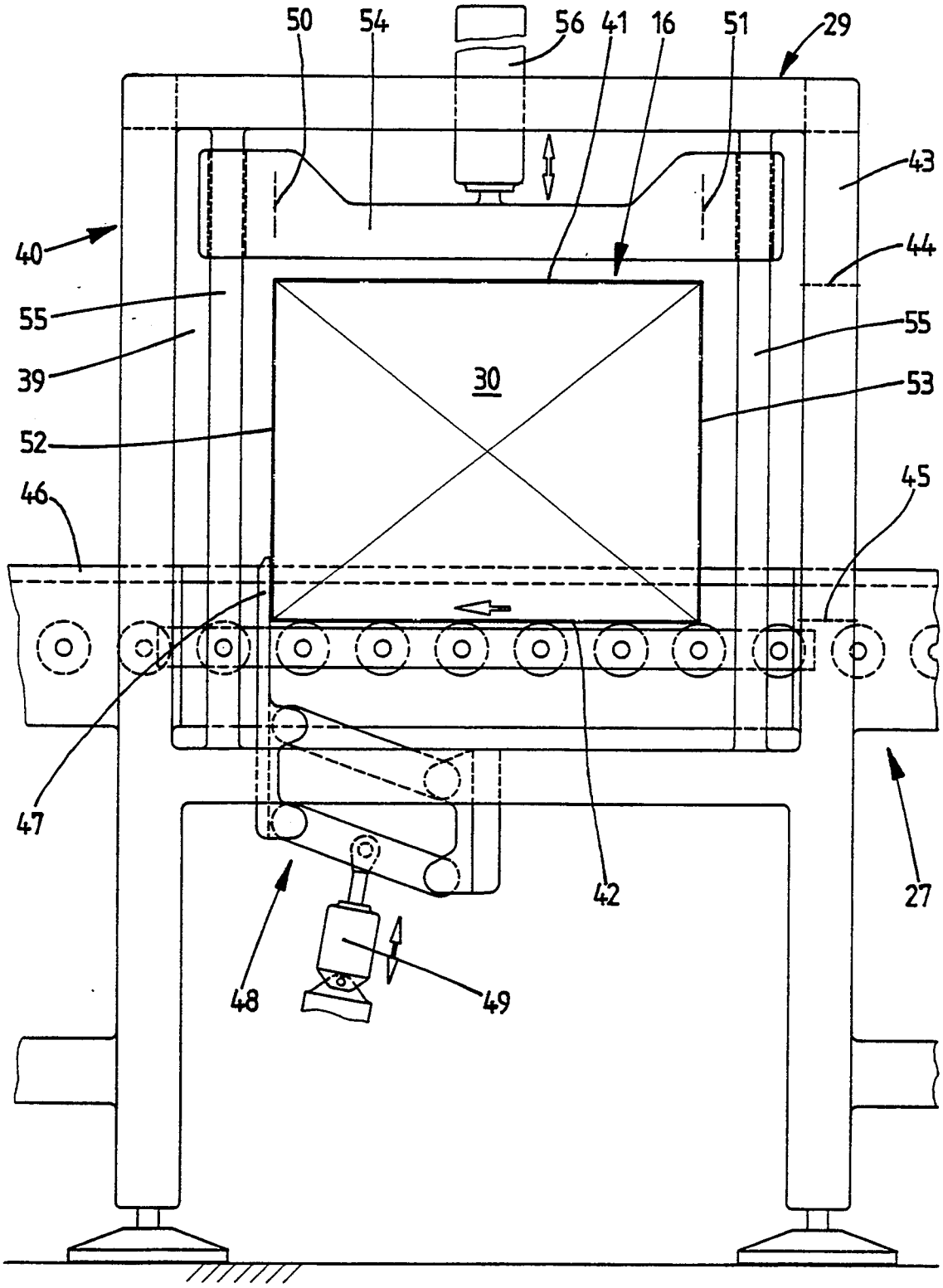
FIG. 5 shows a side view of an enlarged detail from the area of the distributing station, namely a cutting unit.
Figure 6:
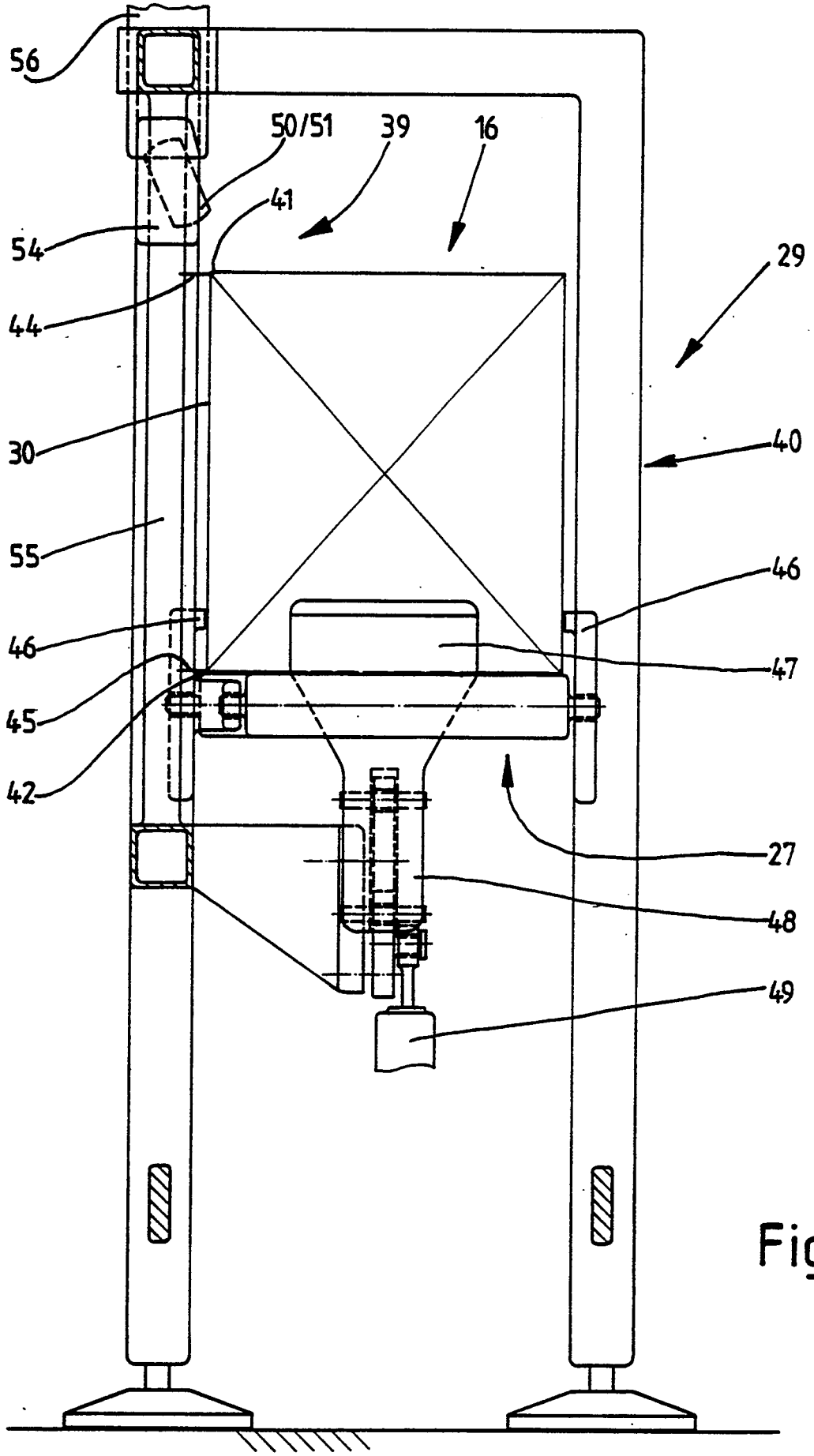
FIG. 6 shows a transverse view, partly sectional, of the unit as shown in FIG. 5.

The conveying system 17 is loaded in the region of a distributing station 22. Here, the arriving cartons 16 with the blanks are grouped to carton stacks 23 (FIGS. 2 and 4). The cartons 16 are one after the other deposited on feed tracks 24, 25 assigned to the carton stacks 23. In the present embodiment, one feed track 24, 25 is assigned to every two carton stacks 23. Said tracks consist of conventional roller conveyors well known in the conveying art, on which the cartons 16 can be conveyed densely packed or spaced out.

The feed tracks 24, 25 lead to a distributing track 26 which in the present embodiment is also designed as a roller conveyor and extends below the conveying system 17 and therewith the transport rail 18.

In the present embodiment, the feed tracks 24, 25 have a reception flank 27, where the cartons 16 are loaded on said tracks. The reception flank 27 is directed transverse to the distributing track 26. Via a bend, the reception flank 27 merges into a transfer flank 28, parallel to the distributing track 26 and extending directly next to the latter without any intermediate space.

The operating sequence of the plant as shown in FIG. 2 can be described as follows: The cartons loaded on the feed tracks 24, 25 are laterally opened in the region of a cutting station 29 which means cutting a side wall 30 out of the carton 16. The projections of the blank stacks 15 formed by the inner lid tabs 14 are located in the region of this open side wall 30.

The open cartons 16 then reach an extraction station 31. Here, the blank stacks 15 are taken out through the open side wall 30 while the cartons 16 come to a momentary halt. In the shown embodiment, all (four) blank stacks 15 are extracted together and are directly transferred into special transport containers, namely cassettes 32, with the extraction movement. Consequently, the carton 16 on the feed track 24, 25 and the cassette 32 on the distributing track 26 are located directly opposite one another in alignment in the region of the extraction station 31.

Then, the cassettes 32 with the blank stacks 15 are transported a small distance on the distributing track 26 in the direction as indicated by arrow 33. Thus, the cassettes reach the region of one of several successive lifting stations 34. Each of these lifting stations 34 is provided with a vertical conveyor 35 which consists of a conveying box 37 movably arranged on a vertical column 36 and having a laterally projecting supporting frame 38 for supporting one cassette 32 at a time. The supporting frame 38 of the conveying box 37 and the supporting frame 21 of the runway trolley 19 are adapted to one another such that the cassette 32 is transferred from the vertical conveyor 35 to the conveying system 17 by means of controlled relative movements. Reference is made to DE-A-38 27 917.7 for further details of the transport unit, including the vertical conveyor. The cassettes 32 emptied in the region of packaging machines are conveyed back by the conveying system 17 via one of the vertical conveyors 35 onto the distributing track 26, ready for being filled again in the aforedescribed way.

The side walls 30 of the cartons 16 are automatically cut out and removed in the cutting station 29. For this purpose, the cutting station 29 is provided with a cutting unit 39 which is attached to a framelike supporting framework 40. As the cartons 16 are coming into the cutting station 29 or into the region of the supporting framework 40, upper and lower severing cuts are applied, specifically directly adjacent to upper and lower side edges 41, 42. For this purpose, horizontally directed upper and lower cutting knives 44, 45 are attached to vertical struts 43 of the supporting framework 40. The cutting knives 44, 45 project into the path of motion of the cartons 16, such that the horizontal severing cut is applied by way of the conveying movement of said cartons 16 past the cutting knives 44, 45. In this region, the cartons 16 are kept on a precisely oriented path of motion relative to the cutting knives 44, 45 by means of guide rails 46 arranged on both sides.

The cartons run up to a movable stop 47 in the region of the cutting station 29. The plate-like stop 47 is arranged on parallelogram rods 48 such that it is movable up and down. The parallelogram rods 48 are pivoted on the supporting frame 38. A pressure medium cylinder 49 serves for moving the stop 47 in and out of the path of motion of the carton 16.

The (upper) stop position of the stop 47 exactly positions the carton 16 relative to two cutting knives 50, 51 cutting in the vertical direction. Said knives serve for applying vertical cuts adjacent to front edge 52 and rear edge 53 of the carton 16.

For this purpose, both (vertical) cutting knives 50, 51 are movable up and down. In the present embodiment, said knives are arranged on a crossbar 54 pointing in the conveying direction which can be moved up and down on lateral supporting bars 55 by means of a cylinder 56. The severing cut is preferably applied when the cutting knives 50, 51 or the crossbar 54 are moving upwards. Consequently, the starting position of the crossbar 54 is located below the path of motion of the cartons 16.

The cut-out side wall 30 is mechanically or pneumatically removed in the region of the cutting station 29. In the present embodiment, a pivot arm 57 is provided with a suction head 58 which grasps the side wall and holds it by means of a vacuum. The side wall 30 is moved out of the region of the cutting station 29 by moving the pivot arm 57.

The horizontal and vertical severing cuts are preferably applied at a distance of 3 to 5 mm to the respective carton edge. Upstream of each cutting station 29, a stock of cartons 16 is formed on the feed tracks 24, 25.

The open carton 16 now reaches the extraction station 31, its open side facing an extraction unit 59 (FIG. 2) for the blank stacks 15.

The extraction unit 59 consists of at least one clamping means 60 (FIGS. 7–10) for grasping a blank stack 15 in the carton 16. In the embodiment shown in the drawings there are four blank stacks 15 side by side in one carton 16. Accordingly, the extraction unit 59 is equipped with four clamping means 60 arranged side by side, each assigned to one blank stack 15.

Each clamping means 60 consists of two elongated vertical clamping jaws 61, 62. These grasp the inner lid tabs 14 lying on top of one another in the blank stack 15 by means of clamping faces 63 made of elastic material. Said clamping faces 63 contact oppositely situated narrow sides of the inner lid tabs 14. The clamping jaws 61, 62 are designed as two-armed levers being pivotally connected to one another via a common joint 64 with vertical axis of rotation.

The joint 64 is located on a supporting arm 65 which is horizontally directed in this case and made of a square or quadratic hollow profile. At the end of said profile there is attached a transversely directed joint bolt 66 on which the two clamping jaws 61, 62 are rotatably mounted with bearing openings.

Actuating arms 67, 68 of the clamping jaws 61, 62 are connected to actuating rods 69, in the present embodiment designed as toggle lever rods. Each actuating arm 67, 68 has assigned a guide rod 70, 71. Both guide rods 70, 71 meet in a common toggle joint 72 to which a piston rod 73 of a pressure medium cylinder 74 assigned to each clamping means 60 is engaged. Just like the piston rod 73, said cylinder is arranged within the hollow supporting arm 65.

At the free end of the supporting arm 65, a vertical supporting crosspiece 91 is disposed in the area between the clamping jaws 61, 62 which is extending across the full height of the clamping jaws 61, 62 in the form of a flat bar. For grasping a blank stack 15, this supporting crosspiece 91 is driven against the front side thereof, specifically against the outer edges of the superposed inner lid tabs 14, which aligns the blank stack 15. Furthermore, the carton 16—including its contents—is aligned by way of the supporting crosspiece 91 abutting the carton at the side oppositely situated to the feed track 24, 25, specifically by abutting a holder for the carton 16 which will be described further below.

The four supporting arms 65 are connected to one another via a cross strut 75 to jointly form an extraction unit 59. The cross strut 75 itself can be moved to and fro by a common cylinder 76 centrally engaging the strut.

Figure 7:
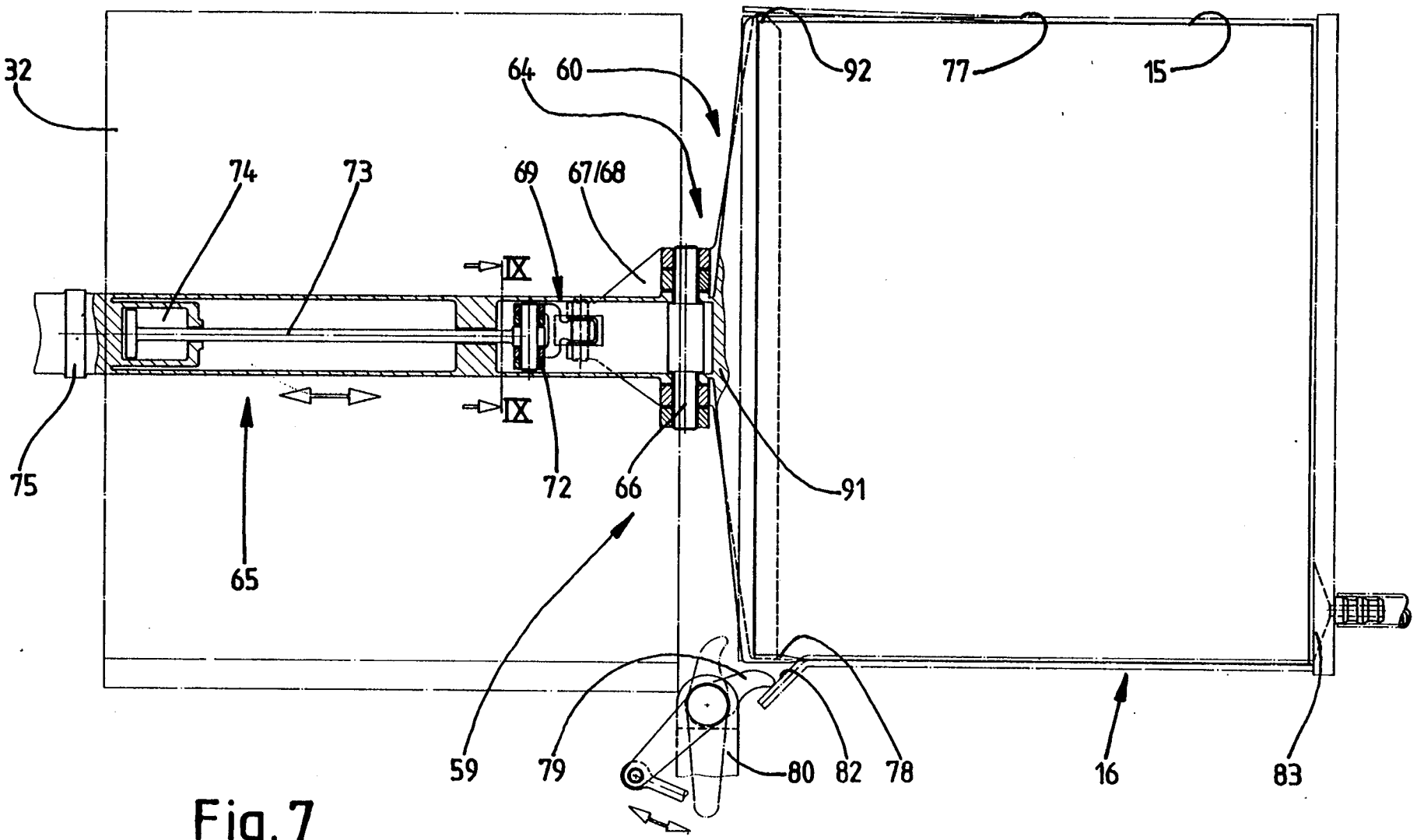
FIG. 7 shows a side view, partly as longitudinal section, of an extraction unit for extracting blank stacks from a carton.
Figure 8:
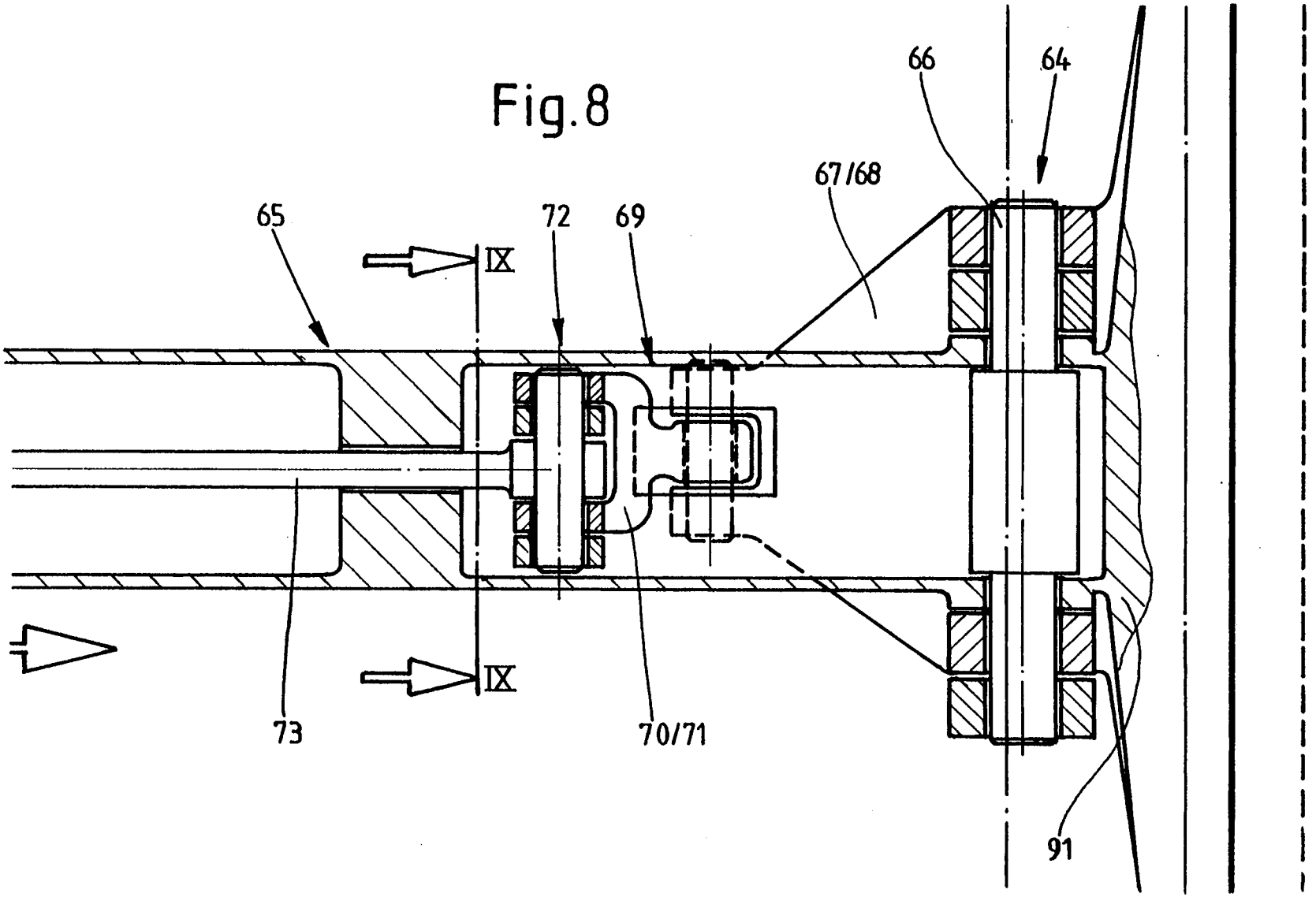
FIG. 8 shows an enlarged detail of the representation as shown in FIG. 7.
Figure 9:
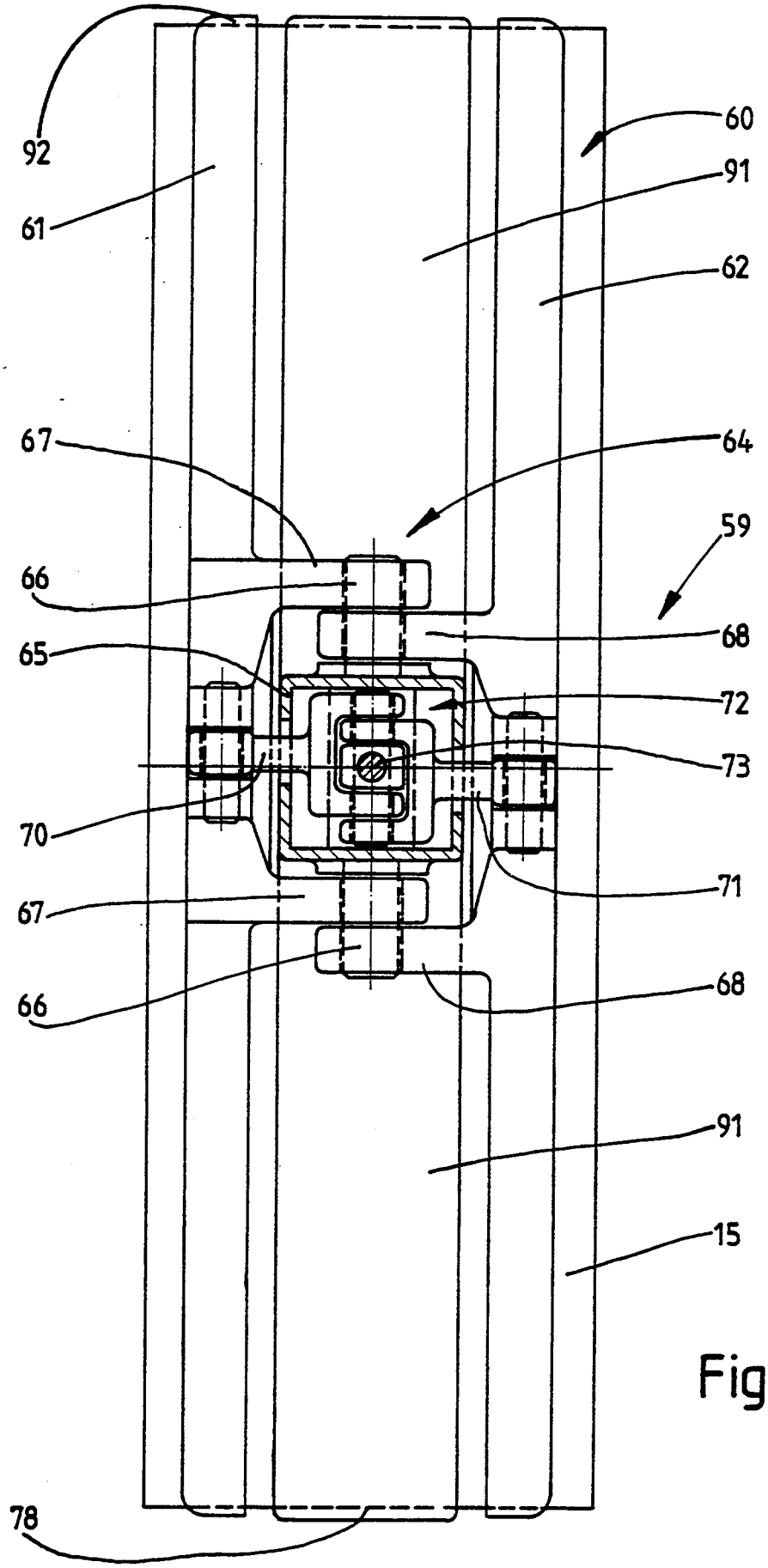
FIG. 9 shows a section taken along the line IX—IX of FIG. 7 and FIG. 8.
Figure 10:
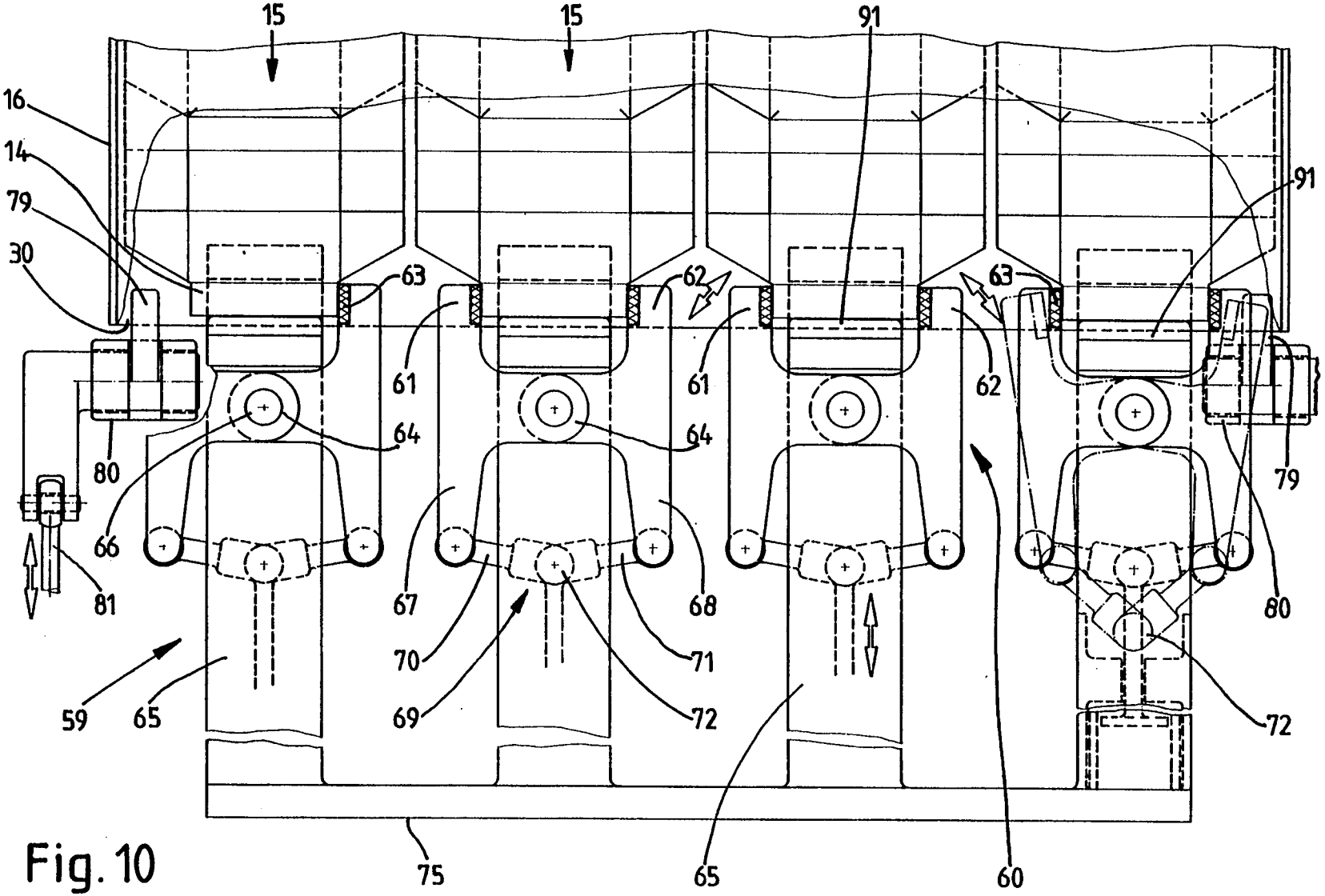
FIG. 10 shows a plan view of the extraction unit.

As shown in FIG. 7, the clamping jaws 61, 62 are designed with upper projections 92, such that an upper wall 77 of the carton 16 is slightly pushed upwards by the clamping jaws 61, 62 when they enter the open carton 16. At the bottom side, a projecting and horizontally directed supporting leg 78 is disposed on the supporting crosspiece 91. This supporting leg 78 grips underneath the front, that is to say the forward region of the blank stack 15, when the clamping means 60 is driven with the supporting crosspiece 91 against the blank stack 15. The supporting leg 78 prevents the lower blanks 10 of the blank stack from deforming (bending) when the clamping force is applied.

Furthermore, pivot fingers 79 are provided in each extraction station 31 engaging in the region of the sides or lower corners of the cartons 16. These pivot fingers 79 are mounted stationary on a bracket 80 and are pivotally moveable by means of an actuating bar 81. The free and slightly curved leg of the pivot finger 79 engages the upper side of a bottom wall 82 of the carton 16 and presses it down so that the clamping jaws 61, 62 can be inserted into the open carton 16 without any obstructions or use of force.

The carton 16 is held at the side opposite to the open side, so that the carton is not moved when the blank stacks 15 are pulled out. For this purpose, a vacuum holding head 83 engages the closed side wall 84 of the carton 16 and holds the same in position on the feed track 24, 25.

The blank stacks 15 are directly pulled into the cassette 32 by the extraction unit 59 when leaving the carton 16. In the present embodiment, this cassette 32 consists of a cassette bottom 85 and upright partition walls 86 which form chambers 87 which are open at the top and at the sides, each for receiving one blank stack 15. The clamping means 60 are moved through the chambers 87 of a cassette 32 together with the elongated supporting arms 65 up to the blank stacks 15 in the carton 16. A backward movement takes the blank stacks directly into the cassette 32 adjoining the carton 16.

When the filled cassettes 32 are transferred to a vertical conveyor 35, first the supporting frame 38 is moved to a plane below the distributing track 26 or roughly at the same height of the latter in order to receive the cassette 32. For this purpose, gaps have been left in the region of the vertical conveyor 35 by leaving out one roller of the roller track for each gap. Through these gaps, lower supporting beams 88 of the forked supporting frame 38 can be moved. When the cassette 32 is transported to the position of transfer to the vertical conveyor 35, the supporting beams 88 are located underneath the cassette 32. Moving the conveying box 37 upwards together with the supporting frame 38 automatically lifts the cassette 32 off the distributing track 26.

The conveyors (feed track 24, 25; distributing track 26) designed as roller conveyors are each provided with stoppers 89 which are assigned to these tracks in the region of stations in which cartons 16 or cassettes 32 have to be temporarily stopped. The stoppers 89 are arranged on one side of the respective conveyor and, upstream of the respective station, press one carton 16 or one cassette 32 against an opposite side boundary of the conveyor or a lateral guide 90 thereof and herewith bring the cartons 16 or the cassettes 32 to a halt. Following cartons 16 or cassettes 32 come up behind and are also halted. After the necessary operation in the respective station is completed, the stopper is moved back to the initial position and the transport continues.

The transport system within the packaging plant having a plurality of packaging machines is designed as a circuit. The emptied cassettes 32 are conveyed back to the central entry station (distributing station 22) by the conveying system 17. Exclusively in this region of the packaging plant, the goods are received and the empties returned.

What is claimed is:

1. An apparatus for handling stacks of blanks for hinge-lid packs, each blank (10) having a narrow projection, in the form of an inner lid flap (14), at a top end of the blank, such that superposed narrow projections of the blanks in each stack form vertically upright oppositely situated side faces at an edge of a stack (15) having a height, said apparatus comprising:

a handling unit (59) having at least one tongs-like clamping means (60) comprising clamping jaws (61, 62) for grasping the blank stack (15) at the side faces of the stack that are formed by the narrow projections;

wherein the clamping jaws (61, 62) of said clamping means (60) are arranged vertically upright with a longitudinal dimension in the vertical direction, thereby forming a vertically extending intermediate space; and said clamping jaws (61, 62) are movable toward one another in a horizontal direction and have a length sufficient to extend from a lower edge of the stack up to approximately the same height as the stack.

2. The apparatus as claimed in claim 1, wherein said handling unit (59) has a plurality of clamping means (60), located on a common carrier (75), for simultaneously grasping a plurality of blank stacks (15).

3. The apparatus as claimed in claim 2, wherein said common carrier is a cross-strut (75) that is movable, in a horizontal direction transversely relative to the movement of the clamping jaws (61, 62), to and fro by a cylinder which centrally engages said cross-strut.

4. The apparatus as claimed in claim 1, wherein said clamping jaws (61, 62) are two-armed pivoted levers with free ends that are loadable with clamping force, via actuating rods (69), by a common pressure medium cylinder (74).

5. The apparatus as claimed in claim 1, wherein the stacks (15) are in a carton (16); and wherein said clamping jaws (61, 62) have upper projections (92) which project beyond the height of the stack (15) and which lift an upper carton-wall, resting on the stack (15), when said clamping jaws (61, 62) move toward the stack.

6. The apparatus as claimed in claim 1, wherein said handling unit (59) has at least one additional said clamping means (60); and wherein, for an alignment of the blank stacks (15), each said clamping means is associated with an upright supporting crosspiece (91) which is disposed between the clamping jaws (61, 62) and which is movable against an upright confronting end face of the blank stack (15) together with said clamping means (60).

7. The apparatus as claimed in claim 6, wherein said upright supporting crosspiece (91) has, at a lower end thereof, a projecting and horizontally directed supporting leg (78) for grasping underneath the blank stack (15).

8. An apparatus for handling stacks of blanks for hinge-lid packs, each blank (10) having a narrow projection, in the form of an inner lid flap (14), at a top end of the blank, such that superposed narrow projections of the blanks in each stack form vertically upright oppositely situated side faces at an edge of a stack (15) having a height, said apparatus comprising:

a handling unit (59) having at least one tongs-like clamping means (60) comprising clamping jaws (61, 62) for grasping the blank stack (15) at the side faces of the stack that are formed by the narrow projections;

wherein each clamping means (60) is associated with an alignment means for the blank stacks (15), said alignment means comprising an upright supporting crosspiece (91) which is disposed between the clamping jaws (61, 62) and which is movable against an upright confronting end of the blank stack (15); and wherein said upright supporting crosspiece (91) has, at a lower end thereof, a projecting and horizontally directed supporting leg (78) for grasping underneath the blank stack (15).

9. A process for handling stacks (15) of blanks for hinge-lid packs by using the apparatus of claim 1, 2, 3, 4, 5, 6, 7 or 8, each blank (10) having a narrow projection in the form of an inner lid flap (14) at a top end of the blank, such that superposed narrow projections of the blanks in each stack form vertically upright oppositely situated side faces at an edge of the stack, said process comprising the steps of grasping, lifting and moving the stacks by means of pressure exerted on the side faces.

* * * * *